United States Patent [19]

Sideri et al.

[11] Patent Number: 4,493,433

[45] Date of Patent: Jan. 15, 1985

[54] SELF-LOCKING PILFER PROOF TAMPER EVIDENT CONTAINER

[75] Inventors: Leonardo Sideri, 561 Broadway, New York, N.Y. 10012; Enzo Del Brocco, Stamford, Conn.

[73] Assignee: Leonardo Sideri, New York, N.Y.

[21] Appl. No.: 598,914

[22] Filed: Apr. 10, 1984

[51] Int. Cl.[3] ..... B65D 41/16; B65D 41/18; B65D 49/12

[52] U.S. Cl. ..... 220/306; 206/1.5; 206/469; 206/806; 206/807; 220/307

[58] Field of Search ..... 206/1.5, 806, 807, 469, 206/820; 220/306, 307; 217/127, 89

[56] References Cited

U.S. PATENT DOCUMENTS 579,560 3/1897 Caillet ..... 217/127
1,168,020 1/1916 McVoy ..... 217/89
2,420,125 5/1947 Crist ..... 206/1.5
2,695,723 11/1954 Waterman ..... 206/820
4,445,622 5/1984 Sideri ..... 206/469

FOREIGN PATENT DOCUMENTS 2460855 7/1979 France ..... 220/306
2017049 9/1979 United Kingdom ..... 206/806

*Primary Examiner*—William T. Dixson, Jr.
*Attorney, Agent, or Firm*—Fitzpatrick, Cella, Harper & Scinto

[57] ABSTRACT

A self-locking pilfer proof tamper evident container comprises two walled panels, within which walls are placed interlocking tabs when brought together to close the container in a manner whereby the container must be destroyed to gain access to its contents.

9 Claims, 9 Drawing Figures

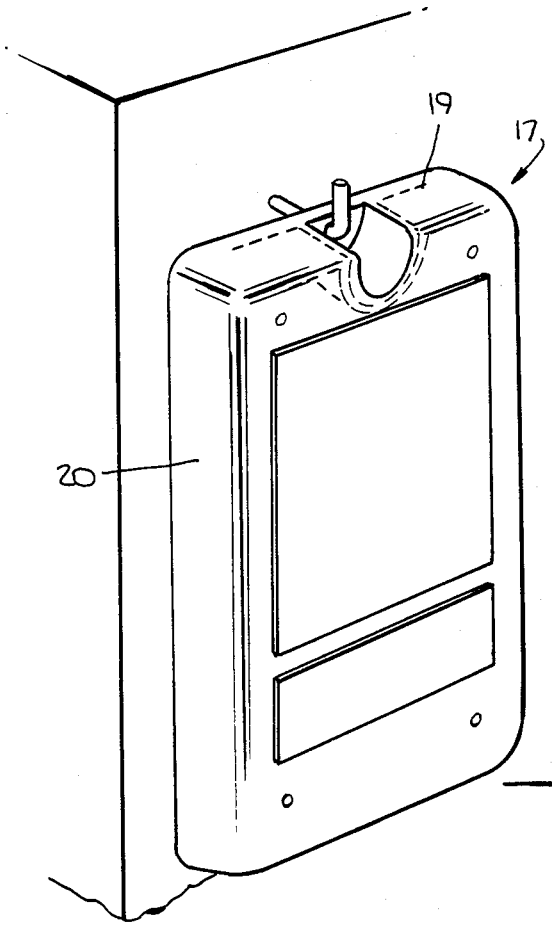
Fig. 1.
Fig. 4.
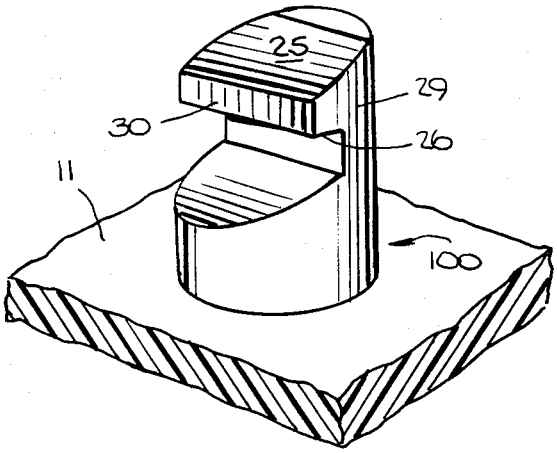
Fig. 5.
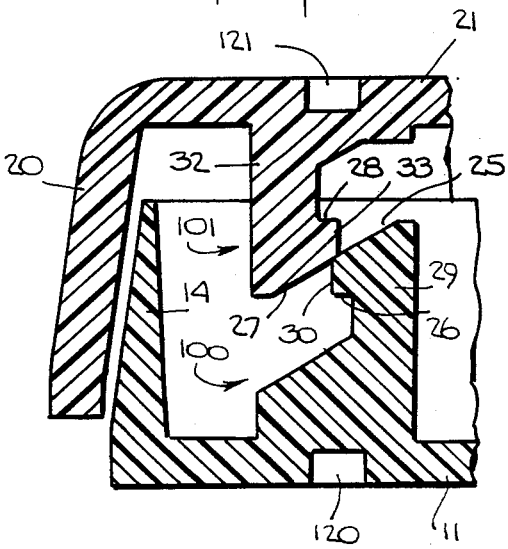
Fig. 6.
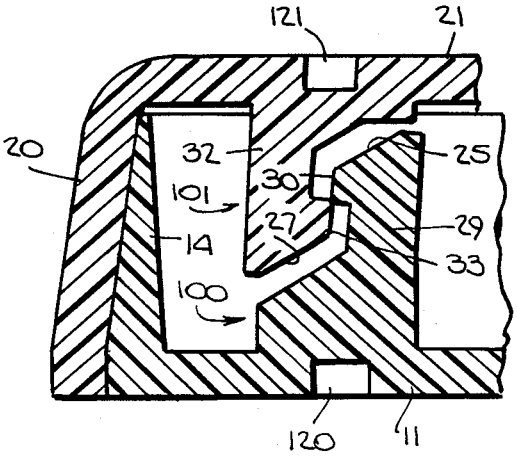

SELF-LOCKING PILFER PROOF TAMPER EVIDENT CONTAINER

BACKGROUND OF THE INVENTION

1. Field of the Invention

This invention relates to containers, and more particularly to self-locking containers which, once closed, cannot be opened without giving a visual indication of that fact.

Containers of the type here contemplated find a wide variety of applications. For example, in many jurisdictions, apartment dwellers or lessees are required to provide the landlord a key to their premises. These keys are often stored in readily available locations and tagged to identify the premises to which they provide access. Many tenants are uncomfortable with this requirement since they cannot know when or for what reason their premises have been entered, unless specifically advised. Thus, there is a need for a key storage system which will enable a tenant to know that access has been had to his key, and thus his premises; and, at the same time to store the key in a manner which will limit identification of the premises to which the key provides access.

2. Description of the Prior Art

A number of self-locking cartons or the like are known which are fabricated at least partially from cardboard or paperboard, as disclosed, for example, in U.S. Pat. Nos. 2,834,531 and 3,025,958. Containers of this type may be opened by cutting with a sharp, thin blade along a crease or corner and then reclosing them with a transparent adhesive or the like to prevent or delay detection of tampering.

Other containers employ a tear sheet to expose adhesive surfaces, as taught in U.S. Pat. No. 3,144,935, to gain access to the container contents, such containers being resealable, while U.S. Pat. No. 3,896,965 is directed to a tamper indicator tape for a hermetically sealed container, the tape being removable and changing color when flexed to indicate that the container has been tampered with. U.S. Pat. No. 4,197,94 discloses a transparent container cover which becomes opaque when flexed.

British Pat. No. 2,017,049 to Pierer discloses reusable sales packs, known as blister packs, that are opened without difficulty, i.e., without their permanent and visible destruction. The Pierer sales packs include a detent strip which, otherwise extending all round the lid, is interrupted at least in one corner zone so that opening the pack is facilitated.

French Pat. No. 7918535 to Burbon is directed to a container which is reusable numerous times for identical or similar articles, and which is opened without damage by the tool shown in FIG. 5.

Another self-locking container is the subject of copending U.S. Ser. No. 396,722, filed July 9, 1982 now U.S. Pat. No. 4,445,622. The non-reusable container therein disclosed comprises a first panel including a surface, the walls extending generally orthogonally from the surface, and a first cam with a locking surface; a second panel including a surface, walls extending generally orthogonally from the surface, and a second cam with a locking surface; the first and second cams being adapted to telescopically engage one another resiliently to flex one away from the other; the locking surfaces being adapted for mutual engagement to permanently lock the cams in mutual engagement; the side walls and walls being adapted to protect the cams and locking surfaces from disengagement; the first and second panels forming an enclosure which is permanently locked against entry upon completion of the telescoping movement, except by the permanent and visible destruction of the container.

The self-locking container of the present invention can be manufactured even more economically than the self-locking container of U.S. Pat. No. 4,445,622, since the present invention does not require a mechanical or cam activated mold, i.e., one with internal moving parts, to separate the undercut panels from the mold. This is accomplished by aligning all locking surfaces of each panel in one orientation, e.g., in the "x" direction, as latter described. Thus, the mold can be separated from each panel without the need for internal movable parts, thereby permitting a smaller mold, that in the manufacturing process can produce more containers in a given period of time.

Additional patents of interest are U.S. Pat. Nos. 579,560, 655,894, 2,734,624, 3,367,488, 3,527,400, 3,835,995, 3,924,746 and 3,949,931.

SUMMARY OF THE INVENTION

We have conceived and contribute by the present invention a self-locking pilfer proof tamper evident container by which we are able to obviate the foregoing disadvantages. Thus, our self-locking container, while simple and inexpensive to manufacture, must be destroyed, once closed, to obtain access to its contents.

To attain the objectives mentioned above, and to be later expressed, a principal feature of our invention resides in a non-reusable self-locking container comprising: a first panel including a surface, side walls extending generally orthagonally from the surface, and a first tab extending generally orthagonally from the surface within the side walls, the tab defining a cam and a locking surface; a second panel including a surface, walls extending generally orthagonally from the surface, and a second tab extending generally orthagonally from the surface within the walls, the tab defining a cam and a locking surface; the first and second cams being adapted to telescopically engage one another resiliently to flex one away from the other; the locking surfaces being adapted for mutual engagement to permanently lock the cams in mutual engagement; the side walls and walls being adapted to protect the cams and locking surfaces from disengagement; the first and second panels forming an enclosure which is permanently locked against entry upon completion of the telescoping movement, except by the permanent and visible destruction of the container.

Thus, the container is locked together while the tab defining cams and locking surfaces are protected from tampering by the side walls and walls, and the container cannot be opened except by its permanent and visible destruction.

According to another aspect of the invention, we prefer to form at least one of the tab defining cams of a semi-rigid material, although both of them may be thus formed, to provide the resilient flexing that permits the camming and locking action mentioned above. More specifically, we have found that both panels may be formed of high-impact polystyrene which may readily be injection molded, is highly resistant to destructive forces and yet provides the necessary degree of resilient flexing.

The tabs may take the form of spaced and aligned pins, each of which has an inclined surface near its distal end formed for mutual engagement with the inclined surface of a corresponding pin on the other panel, during the telescoping movement to flex at least one of the pins away from the other. Each such pin is also formed with a locking surface that may be perpendicular to the plane of the side walls and walls when in locking condition. In our preferred mode, there are 4 pins per panel, each located generally near a corner of each panel, and the locking surfaces of all pins in each panel are aligned in one direction so as to facilitate separation of the mold from the panel after if has been molded, and each pin being spaced approximately the same distance from adjacent walls or side walls, such spacing being sufficient to facilitate release of the pins from the mold.

When the container is closed, the side walls of the first panel are disposed within the confines of the walls of the second panel, and together the side walls and the walls form an outer barrier that encloses the contents, as well as protects the cams and locking surfaces from tampering.

For identification purposes, we provide at least one of the panels with an external surface area adapted to receive indicia thereon, and the inner surfaces of both panels with a bonded non-transferable surface where signature endorsements may be applied.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for designing other structures for carrying out the several purposes of the invention. It is important, therefore, that the claims be regarded as including such equivalent constructions as do not depart from the spirit and scope of the invention.

BRIEF DESCRIPTION OF THE DRAWINGS

The best mode of the invention has been chosen for purposes of illustration and description, as shown in the accompanying drawings, forming a part of the specification wherein:

FIG. 1 is a perspective view of the device according to the present invention;

FIG. 5 is a partial cross-sectional view illustrating the position of the respective cams or pins during commencement of closing movement of the panels;

FIG. 6 is a view similar to FIG. 5 but illustrating the cams or pins just prior to locking;

FIG. 8 is a perspective view of a pin of the first panel.

Figure 2:
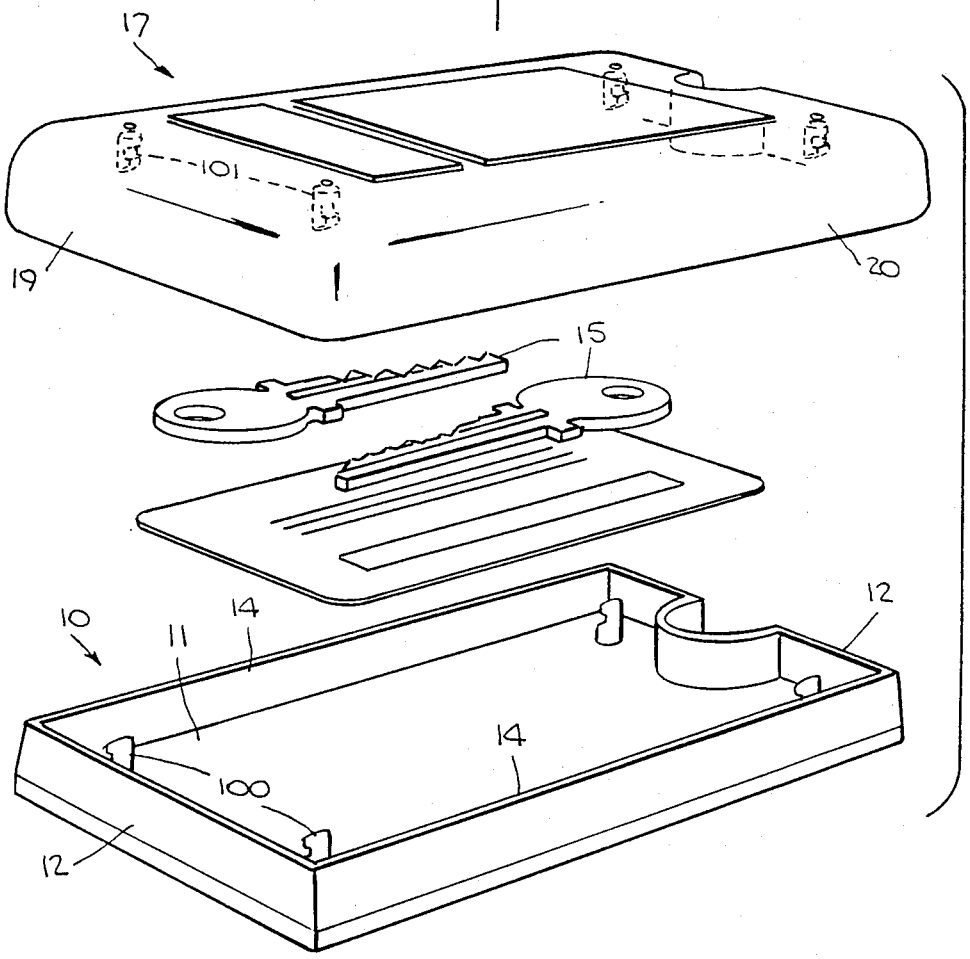
FIG. 2 is an exploded, perspective view of both panels positioned for closing and a pair of keys and a magnetic card to be contained.

Referring now to the drawings, and more particularly to FIGS. 1 to 4, there is shown a first or bottom panel 10 which includes a base 11 and two pairs of opposed side walls 12, 14, each pair being disposed at 90° to the other pair to define an enclosure, and upstanding from the base 11 for receiving the item or items, such as keys 15, to be contained. According to the preferred embodiment, as shown in FIG. 2, tabs in the form of pins 100, approximately four in number, are located near the corners formed by the side walls, and are equally and sufficiently spaced from adjacent side walls to facilitate release from the mold after manufacture.

A second or top panel 17 is shown in FIG. 2 in position opposite the panel 10 to cover the enclosure. This panel 17 is formed with two pairs of opposed walls 19, 20, each pair being disposed at 90° to the other pair to define an enclosure, and upstanding from a base 21, so that upon closing the container the side walls 12, 14 of the bottom panel 10 are located within and adjacent to walls 19, 20 respectively.

It will be seen that within the confines of walls 19, 20 are tabs or pins 101 of corresponding number and location to the tabs or pins 100 of the first panel. Each pin 100 provides an inclined cam surface 25, a sliding surface 30, a locking surface 26, and a neck-like section 29, while each pin 101 provides an inclined cam surface 27, a sliding surface 33, a locking surface 28, and a neck-like section 32. Inclined cam surfaces 25 and 27 of pins 100 and 101 are sloped at an angle on the order of 60° to a vertical, to facilitate the camming action later to be described.

Figure 4A:
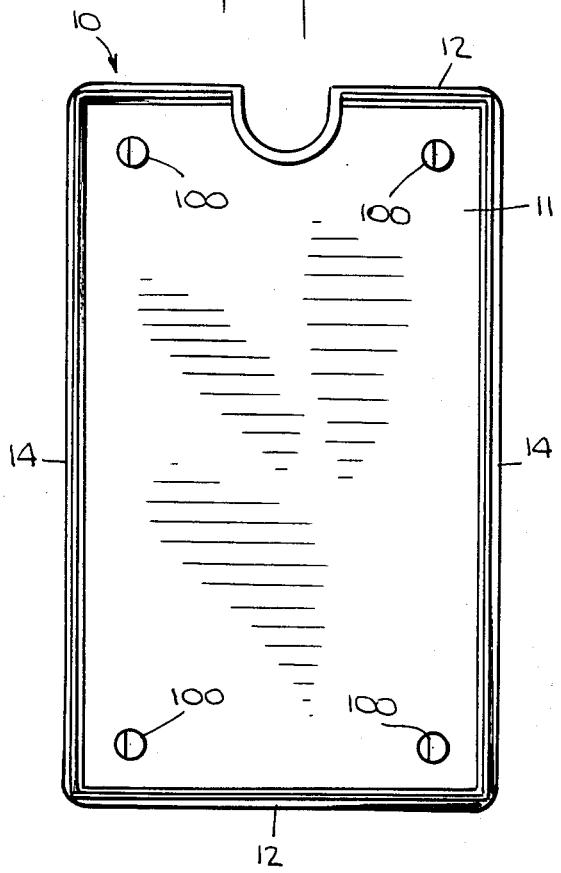
FIGS. 4A and 4B are elevational views illustrating a first or bottom panel and a second or top panel, respectively, for containing items to be secured.
Figure 4B:
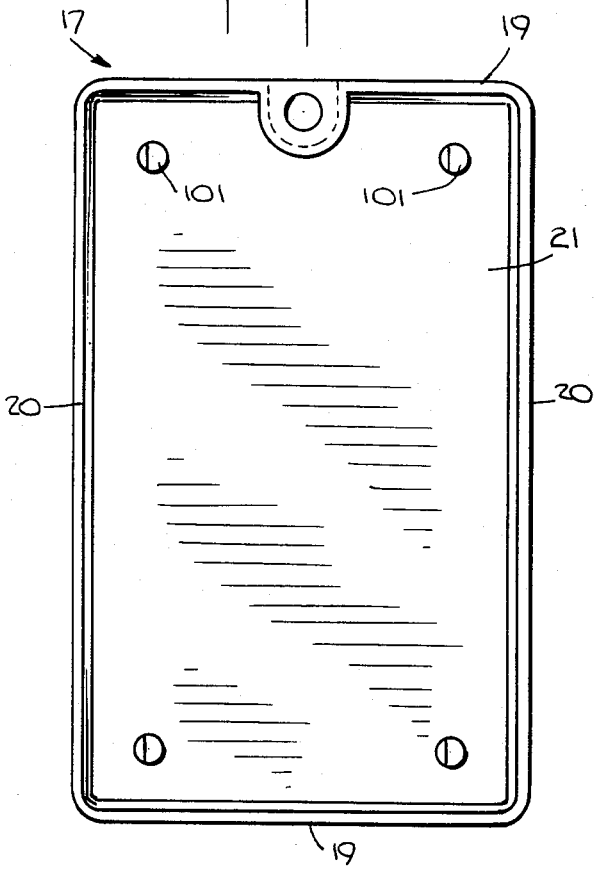

Pins 100 are cylindrical in shape at the end attached to base 11. Likewise, pins 101 are also cylindrical in shape at the end attached to base 21. Flat surfaces 30 and 33 are formed to slide one against the other, as a result of the flexing of one or both pins 100 and 101, after the camming action of surfaces 27 and 25. As referenced above, we prefer to orient all of the locking surfaces on each panel in one direction. That is, as shown in FIGS. 4A, 4B and 5, locking surfaces 26 of the tabs of the first panel are all to the left side of neck-like section 29 of pin 100 as viewed in FIG. 5, and locking surfaces 28 of the tabs of the second panel are all to the right of neck-like section 32 of pin 101 as viewed in FIG. 5.

Figure 7:
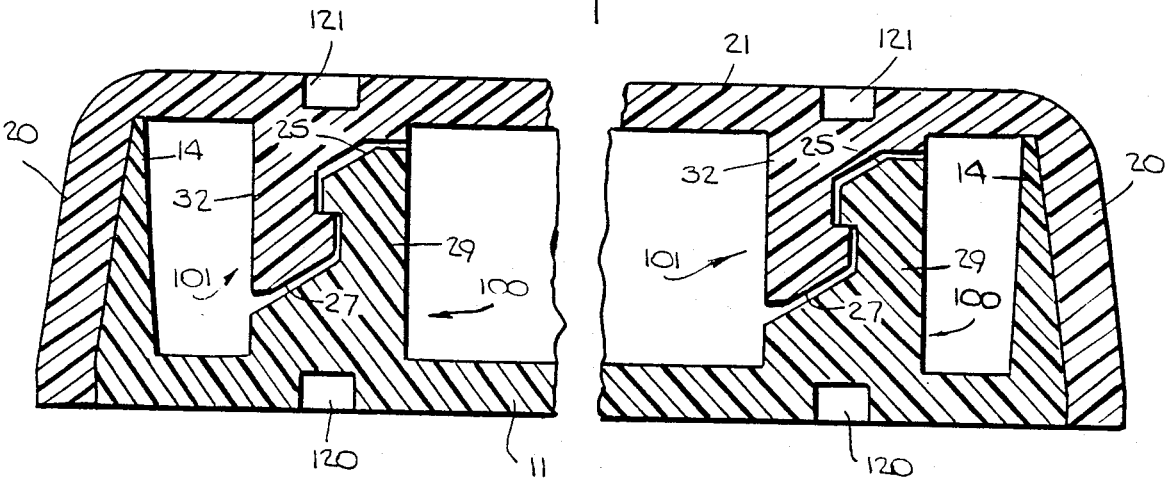
FIG. 7 is a cross-sectional view illustrating the device in closed, locked disposition.
Figure 3:
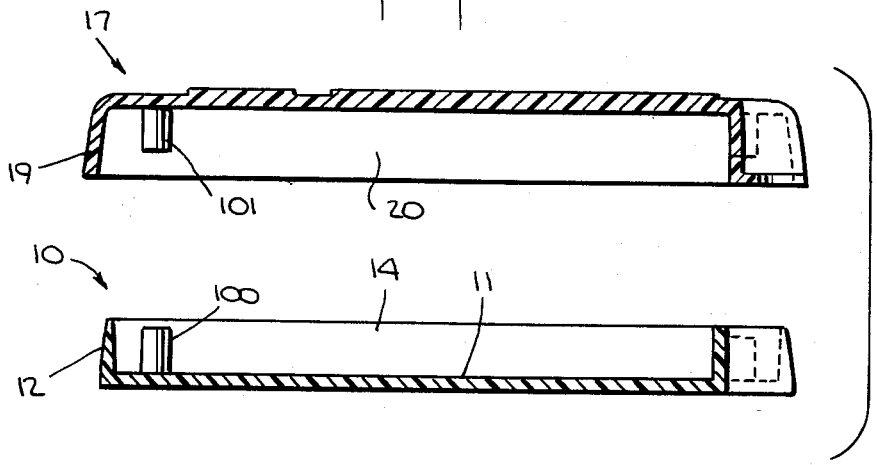
FIG. 3 is an exploded sectional view in cross-section illustrating structural elements of a device according to the present invention.

As shown in FIGS. 5, 6 and 7, we prefer that the exterior surface of panel 10 opposite pin 100 be formed with indentation 120, and that the exterior surface of panel 17 opposite pin 101 be formed with indentation 121, so as to prevent shrink marks on these surfaces after the material has set.

As shown in FIGS. 5, 6, and 7, the side walls 12, 14, walls 19, 20, pins 100 and 101 and associated cam and locking surfaces are so configured and dimensioned that when the panels 10 and 17 are brought together to close the container, the cam surfaces 25 and 27 come into mutual engagement so that the closing force cams the corresponding pins 100 and 101 resiliently away from each other until the respective cam surfaces 25 and 27, and sliding surfaces 30 and 33, pass one another and the locking surfaces 26 and 28 come into alignment, at which point they return to their natural positions, thus bringing respective locking surfaces 26 and 28 into engagement to lock the pins, and therefore the panels, against separation. The exterior surface of side walls 12, 14, and the interior surface of walls 19, 20, are sloped at an angle of the order of 5°, for example, from a vertical, so that in the closed position, side wall 12 will be in contact with wall 19, and side wall 14 will be in contact with wall 20, and the distal end of side walls 12 will be secured within walls 19 and the distal end of side walls 14 will be secured within walls 20, thereby preventing lateral movement of top panel 17 with respect to bottom panel 10, and consequently preventing the disconnection of locking surfaces 26 and 28.

Thus, in the preferred embodiment, and as illustrated in FIG. 7, side walls 12 and 14 of the bottom panel 10 are surrounded by walls 19, 20 and side walls 12, 14 in turn surround the pins. By reason of this construction, it will be impossible to insert a tool between the walls 19 and 20 and the side walls 12, 14 to flex the walls 19 and 20 outwardly to release engagement of the respective locking surfaces of the pins and open the container, without first visibly destroying the container.

The container thus described can be manufactured by existing injection molding techniques. In its preferred embodiment, the closed container measures $4\frac{1}{8}$ inches long, $3\frac{3}{4}$ inches wide and $\frac{5}{8}$ inches deep.

From the foregoing description, it will be seen that a container made according to the present invention, once closed, may be opened only by applying substantial force physically to destroy the same, thus giving a clear indication of access to the container contents.

We may provide a printed, non-transferable surface on the outer surface of one or both of the panel bases and a bonded non-transferable surface, such as a signature foil, on the inside of both panels for the indelible reception of identifying indicia such as a code number, fingerprint, signature or the like so that only the owner of the container contents and those he chooses to make privy to the information will be able to identify them as to ownership.

We believe that the construction and application of our novel self-locking container will now be understood and that the advantages thereof will be fully appreciated by those persons skilled in that art.

We claim:

1. A non-reusable self-locking container comprising:

a first panel including a surface, side walls extending generally orthagonally from said surface, and a first tab extending generally orthagonally from said surface within said side walls, said tab defining a cam and a locking surface a second panel including a surface, walls extended generally orthagonally from said surface, and a second tab extending generally orthagonally from said surface within said walls, said tab defining a cam and a locking surface said first and second cams being adapted to telescopically engage one another resiliently to flex one away from the other said locking surfaces being adapted for mutual engagement permanently to lock said cams to one another said side walls and walls being adapted to protect said cams and locking surfaces from disengagement said first and second panels forming an enclosure which is permanently locked against entry upon completion of said telescoping movement, except by the permanent and visible destructon of said container.

2. A self-locking container according to claim 1 wherein said tabs form pins each having an inclined surface at its distal end and a locking surface nearer its attached end, said inclined surfaces being arranged for mutual engagement during said telescoping movement to flex at least one of said inclined surfaces away from the other.

3. A self-locking container according to claim 2 wherein said locking surfaces are generally perpendicular to the planes of said side walls and said walls.

4. A self-locking container according to claim 1 or claim 2, wherein at least one of said first cam and second cam is formed of a semi-rigid material.

5. A container according to claim 1 or claim 2, wherein said first and second panels are hinged along an axis to bring said cams into cooperative disposition upon relative movement of said panels to close said container.

6. A self-locking container according to claim 1 or claim 2, wherein said panels are molded of high impact polystryene.

7. A container according to claim 1 or claim 2, wherein at least one of said panels includes a surface area adapted to receive indicia thereon.

8. A container according to claim 1 or claim 2, wherein corners are formed by adjacent side walls, and corners are formed by adjacent walls, and a pin is located adjacent to said corners of each panel.

9. A container according to claim 1 wherein each panel is formed with multiple locking surfaces, which locking surfaces are oriented in any one direction.

* * * * *

UNITED STATES PATENT AND TRADEMARK OFFICE

CERTIFICATE OF CORRECTION

PATENT NO. : 4,493,433

DATED : January 15, 1985

INVENTOR(S) : LEONARDO SIDERI

It is certified that error appears in the above-identified patent and that said Letters Patent are hereby corrected as shown below:

Column 5, line 20, change "4 1/8" to --4 3/4--;
line 21, change "3 3/4" to --3 1/8--.

Signed and Sealed this

*Seventh* Day of *May 1985*

[SEAL]

*Attest:*

DONALD J. QUIGG

*Attesting Officer* *Acting Commissioner of Patents and Trademarks*